US008611565B2

(12) United States Patent
Currano et al.

(10) Patent No.: US 8,611,565 B2
(45) Date of Patent: Dec. 17, 2013

(54) MICROSCALE IMPLEMENTATION OF A BIO-INSPIRED ACOUSTIC LOCALIZATION DEVICE

(75) Inventors: Luke J. Currano, Columbia, MD (US); Danny Gee, Houston, TX (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 215 days.

(21) Appl. No.: 13/087,095

(22) Filed: Apr. 14, 2011

(65) Prior Publication Data

US 2011/0311078 A1 Dec. 22, 2011

Related U.S. Application Data

(60) Provisional application No. 61/282,871, filed on Apr. 14, 2010.

(51) Int. Cl.
*H04R 25/00* (2006.01)

(52) U.S. Cl.
USPC ..... 381/151; 381/175

(58) Field of Classification Search
USPC ..... 381/356, 92, 337, 339, 326, 334, 381/151–152, 170–171, 173–175, 380; 181/125
See application file for complete search history.

(56) References Cited

U.S. PATENT DOCUMENTS

| | | | | |
|---|---|---|---|---|
| 2006/0210106 | A1* | 9/2006 | Pedersen | 381/355 |
| 2006/0284516 | A1* | 12/2006 | Shimaoka et al. | 310/322 |
| 2011/0222708 | A1* | 9/2011 | Yu et al. | 381/92 |
| 2011/0299701 | A1* | 12/2011 | Karunasiri et al. | 381/92 |

OTHER PUBLICATIONS

Wang, Q. et al. "Bionic Structure of Mechanically Coupled Diaphragms for Sound Source Localization" (WSEAS Transactions on Systems, vol. 8, Issue 7, pp. 855-865, published Jul. 2009).*

* cited by examiner

*Primary Examiner* — Suhan Ni
(74) *Attorney, Agent, or Firm* — Alan I. Kalb

(57) ABSTRACT

An apparatus and method for creating a MEMS directional sensor system capable of determining direction from at least two microphones to a sound source over a wide range of frequencies is disclosed. By utilizing a stiff beam stand-off architecture that relies on a unique manufacturing technique in a MEMS device, such as described herein, a very small set of microphones, on the order of a few micrometers, can be designed with unsurpassed ability to detect a sound source location.

5 Claims, 3 Drawing Sheets

200

220

230

MICROSCALE IMPLEMENTATION OF A BIO-INSPIRED ACOUSTIC LOCALIZATION DEVICE

CROSS-REFERENCE TO RELATED APPLICATIONS

This application claims the benefit of U.S. Provisional Application Serial Number 61/282,871, filed on Apr. 14, 2010, the complete disclosure of which, in its entirety, is herein incorporated by reference.

GOVERNMENT INTEREST

The invention described herein may be manufactured, used, and licensed by or for the United States Government without the payment of royalties therein.

BACKGROUND

1. Technical Field

The embodiments herein generally relate to microelectromechanical systems (MEMS), and, more particularly, to a new differential microphone having improved frequency response and sensitivity characteristics.

2. Description of the Related Art

Determining the direction of a sound source with a miniature microphone is known in the art. Much of this technology is based on the structure of the ear of a particular parasitic fly *Ormia Ochracea*. Through mechanical coupling of the eardrums, the fly has highly directional hearing to within two degrees of azimuth. The eardrums are known to be less than about 0.5 mm apart such that without mechanical coupling, localization cues would be only around 50 nanoseconds. The mechanical coupling results in up to 30× amplification of this time delay, enabling the exceptionally high direction sensitivity.

The most common approach to constructing a directional microphone is provided by an apparatus comprising sound inlet ports defined by juxtaposed tubes that communicate with a diaphragm. The two sides of the microphone diaphragm receive sound from the two inlet ports. The sound pressure driving the rear of the diaphragm travels through a resistive material that provides a time delay. The dissipative resistive material must be designed to create a proper time delay in order for the net pressure to have the desired directivity.

It is important that the net pressure on the directional microphone is proportional to the frequency of the sound, and thus has a 6 dB per octave slope. The net pressure is also diminished in proportion to the distance between the ports. By reducing the overall size of the diaphragm the result is a proportional loss of directional sensitivity. It can be observed that the 6 dB per octave slope and the dependence on the distance dimension remain even in microphones devoid of the resistive material. A microphone without the resistive material is normally called a differential microphone or a pressure gradient microphone.

Directional microphones, which are commonly used in hearing aids, are normally designed to operate below the resonant frequency of the devices diaphragm. This causes the response to have roughly the same frequency dependence as the net pressure. As a result, the microphone output is proportional to frequency, as is the net pressure. The uncompensated directional output of the microphones in hearing aids exhibits a 6 dB per octave high pass filter shape. To correct for this frequency response characteristic, a 6 dB per octave low pass filter is incorporated in the hearing aid device, along with a gain stage. This yields a "flat" response. The typical microphone package incorporates a witch to allow the user to select between the two response curves.

The problem of electronically compensating for the 6 dB per octave Slope of the diaphragm response is that compensating causes a substantial degradation in noise performance. Any thermal noise introduced by the microphone itself, along with the noise created by the buffer amplifier, is amplified by the gain stage in the compensation circuit. It should be noted that the significant increase in noise is very undesirable.

Hearing aid manufacturers have found it necessary to incorporate switches on hearing aids to allow users to switch to a non-directional microphone mode in quiet environments, where the directional microphone noise proves most objectionable.

The noise inherent in conventional, directional microphones has caused hearing aid microphone designers to use a relatively large port spacing of approximately 12 mm. This is considered to be the largest port spacing that can be used while still achieving directional response at and below 5 kHz the highest frequency for speech signals.

Creating small directional microphones has been dependent upon the product of frequency and port spacing. The distance factor indicates that sensitivity of the device is reduced as its overall size is reduced.

Traditionally, compensating the output signal to achieve a flat frequency response has been accomplished electronically. Unfortunately, this has lead to the amplification of noise sources. The present invention provides a new approach to solving the aforementioned problems. By emulating a mechanical structure similar to that employed in the directionally sensitive ears of the fly, *Ortnia ochracea*, and a functional microphone can be made without having to rely on frequency compensation. A diaphragm not unlike that of the *Ormia Ochracea* ears is very well suited to silicon micro fabrication technology.

For the reasons stated above, there is a need in the art for a miniature microphone system capable of detecting a sound source location over a wide frequency range.

SUMMARY

The present invention is a method and apparatus for a microelectromechanical system (MEMS) implementation of a bio-inspired acoustic localization device. The invention is comprised of at least two adjacent, but separate, compliant diaphragms mechanically coupled together by a stiff beam. The stiff beam is suspended above the diaphragms. The beam attaches to the centers of the diaphragms via at least two anchors. Anchors are disposed between the centers of the diaphragms and the ends of the stiff beam. The anchors act as standoffs for the stiff beam and a rigid connection between the beam and the diaphragms. The anchors are not constrained to areas on the substrate and they can overlap onto the diaphragms. One or more separate anchors may also connect the beam to the substrate to which the diaphragms are connected.

Mote than two diaphragms can be mechanically coupled in order to achieve acoustic localization angle sensitivity in multiple planes. Using three coupled diaphragms two dimensional sensitivity can be achieved. The angle of separation between each diaphragm affects the deice due to the torsion across the stiff beam. Several embodiments of stiff beam and diaphragm are depicted. Each of the embodiments has its own torsion characteristics and some designs have a higher loss than others.

The second part of the invention is the method of fabrication. Method of fabricating the invention starts with the deposition of a thin film for use as a buried etch-stop layer on top of a silicon substrate. The etch-stop material can be silicon dioxide silicon nitride or an of the commonly used etch-stop materials. A second thin film of a diaphragm material is then deposited on top of the etch-stop material. The current embodiment uses amorphous or polycrystalline silicon, but other materials known in the art can be used as well. Next the anchor points are lithographically defined as open holes in a sacrificial layer of photo resist. Next, the beam material is deposited. The beam material may be any material which can be deposited, patterned and etched using MEMS processing techniques. The current embodiment uses a multilayered stack of alternating silicon dioxide and silicon nitride thin films, commonly known in the art as ONO, but other materials known in the art can be used as well. Similarly, reactive ion etching is then used to pattern the coupling beam. Reactive ion etching is also used to form the diaphragm by removing material from the back of the substrate through to the etch stop layer, to form a cavity on the backside of the substrate. Next the diaphragm membrane is freed by reactive ion etching or gas-phase dry etching in order to remove the etch stop layer and thus freeing the diaphragm membrane. Finally, the coupling beam is released through an isotropic oxygen plasma etch process commonly known in the art as an "ash" that removes the sacrificial layer.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

A MEMS directional microphone capable of detecting the direction of acoustic signals arriving from an acoustic source over a wide range of frequencies is disclosed. the following description and the drawings illustrate specific embodiments of the invention sufficiently to enable those skilled in the art to practice it. Other embodiments may incorporate structural, logical, electrical, process and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents.

Figure 1A:
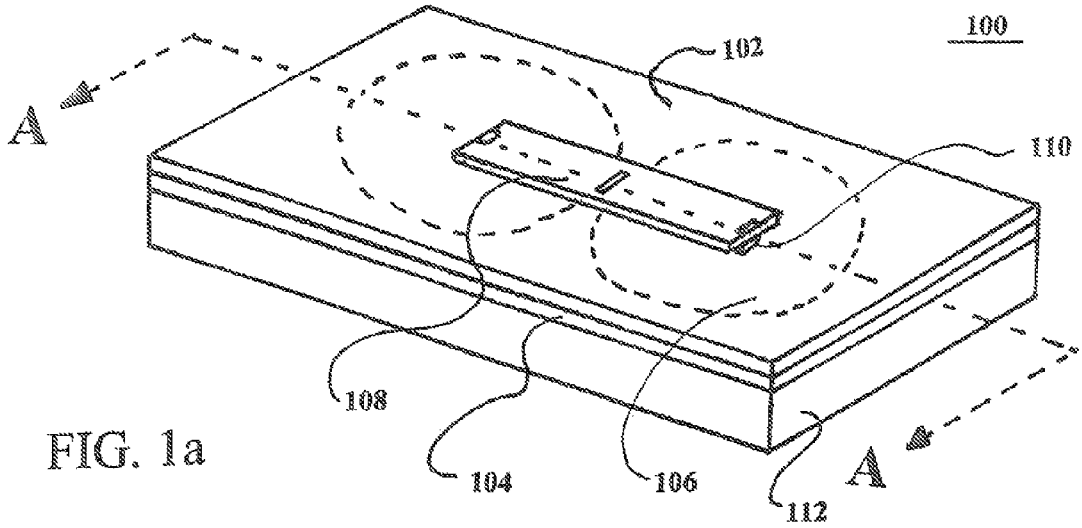
FIG. 1*a* is a perspective view of a MEMS directional microphone having two diaphragms and a single stiff beam according to an embodiment of the present invention.
Figure 1B:
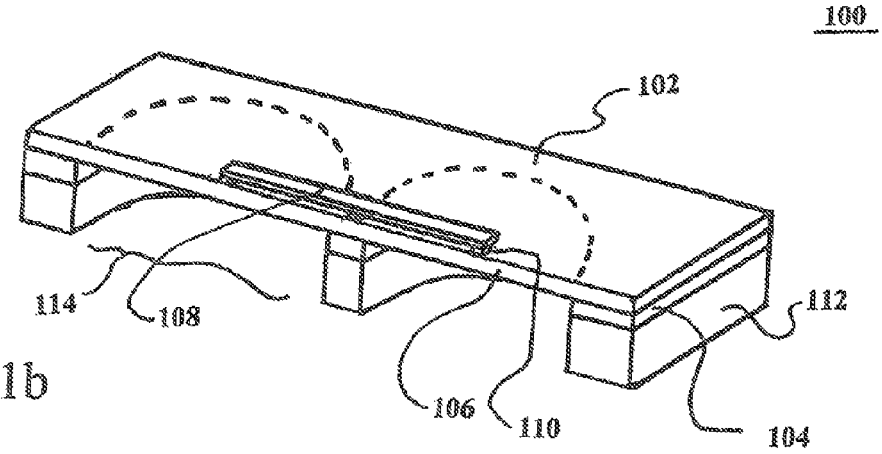
FIG. 1*b* is a perspective cutaway view taken along section lines A-A of a MEMS directional microphone having two diaphragms and a single stiff beam according to an embodiment of the invention.

Referring to FIGS. 1*a* and 1*b*, the invention depicts at least two adjacent but separate compliant diaphragms 106 fabricated in a portion of a larger substrate 112. These diaphragms 106 are mechanically coupled together by means of a stiff beam 108. The beam 108 is suspended and affixed by means of standoff anchors 110 above the diaphragms 106. The beam attaches to the center of each diaphragm 106 via an anchor 110. In at least one embodiment the beam 108 attaches to the substrate 112 via an anchor 110. The anchor 110 is attached to the substrate 112 in the center of the stiff beam 108; this center anchor 110 forms a pivoting point. The dimensions of the anchors 110 are smaller than the beam 108, and while the stiff beam 108 is not limited to any specific geometry a rectangle has been depicted for clarity. Similarly, the anchors 110 have been shown as rectangular. The central anchor 110 is not constrained exclusively to an area on the substrate 112 but it can overlap onto the diaphragms 106. In at least one embodiment the central anchor 110 has been removed completely from the design, forming a floating point. In this specific embodiment there is a measurable performance loss.

Figure 2A:
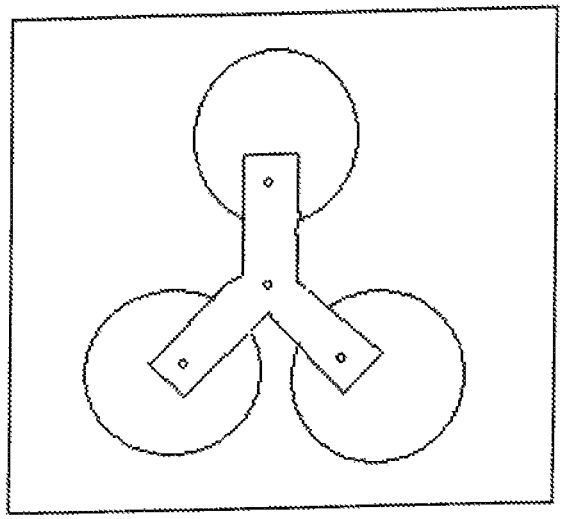
FIGS. 2*a* through 2*c* are top plan views depicting a MEMS directional microphone having various arrangements of three diaphragms and depicting several embodiments of stiff beam architecture all in accordance with the present invention.
Figure 2B:
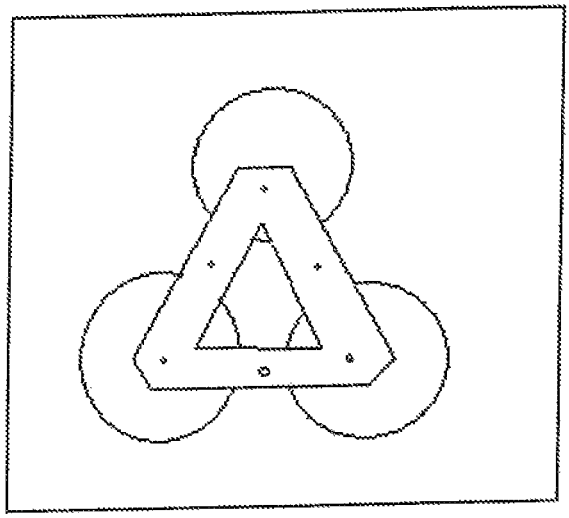
Figure 2C:
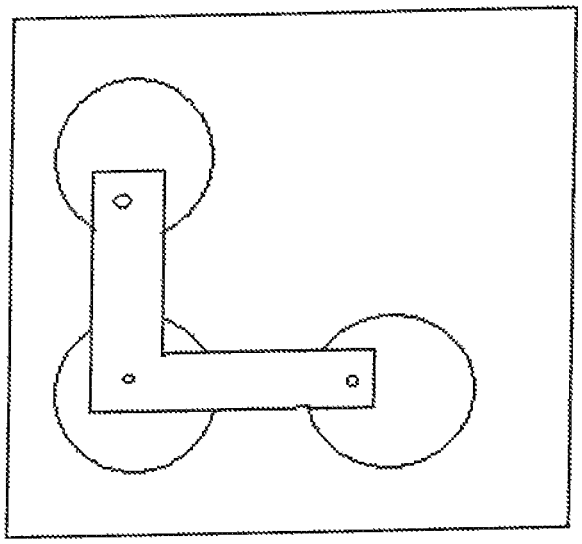
Figure 3A:
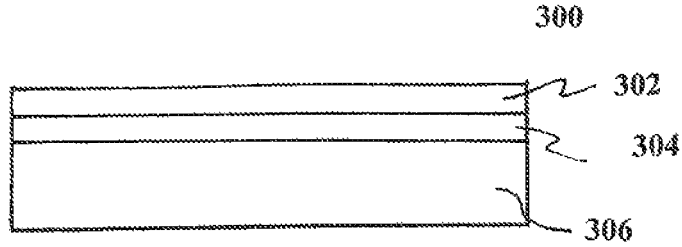
FIGS. 3*a* through 3*e* illustrate graphically the method of successive steps for manufacturing a MEMS directional microphone actuator according to an embodiment of the present invention.
Figure 3B:
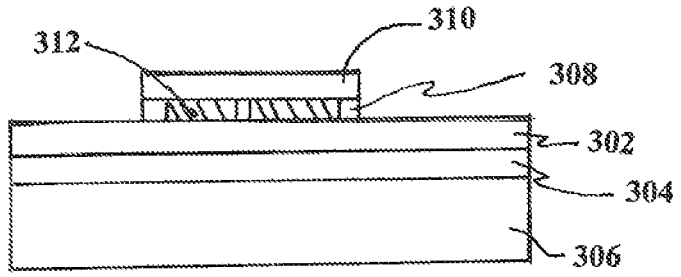
Figure 3C:
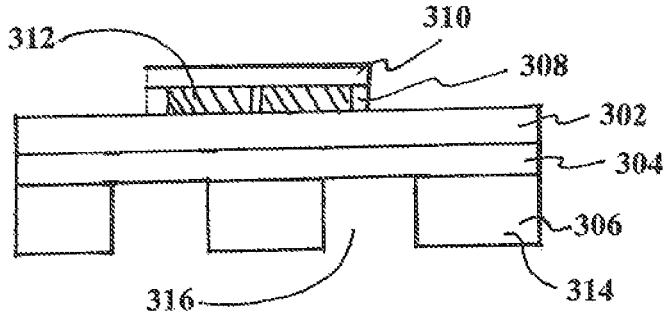
Figure 3D:
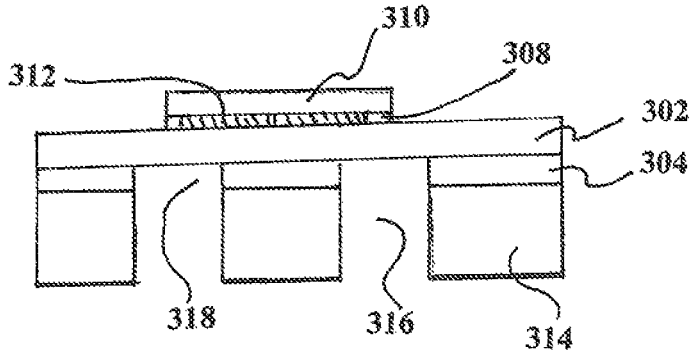
Figure 3E:
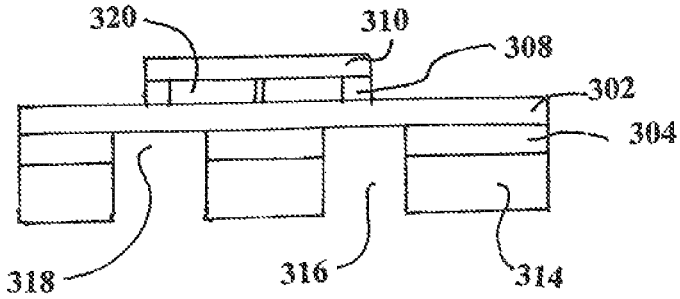

Referring now to FIGS. 2*a*-2*c*, a plurality of diaphragms 106 are depicted that are coupled together by means of a stiff beam 108 would be able to achieve multi-axis acoustic localization sensitivity. Using three coupled diaphragms two-dimensional sensitivity is predicted. It has been determined that the angle of separation between each diaphragm affects the device response due to the torsion across the coupling beam. A device with three diaphragms based at equal lateral angles as shown in FIG. 2*b*. The layout of the beam can be varied in a wishbone or triangular pattern. The wishbone shaped beam is expected to have greater losses due to tortional effects. To isolate the torsional losses of a three diaphragm device, the spacing of the diaphragm and the required perpendicular angles are illustrated in FIG. 2*a*; FIG. 2*b*; and FIG. 2*c* respectively.

Referring now to FIGS. 3*a*-3*e*, the method of fabricating the invention is illustrated as follows; first is the step of deposing of a thin film as a buried etch stop layer 304 on the top side of a silicon substrate 306. The second step is to deposit a thin film on the substrate 306 which will become the diaphragm material 302. The third step is to deposit a sacrificial layer of photo resist 312 patterned with a set of anchor points 308 on the substrate 306. The forth step is to deposit the coupling beam material 310 on top of the substrate 306. The fifth step is to pattern and etch the coupling beam 310 with reactive ion etching (see FIG. 3*d*). The sixth step is to etch the backside 314 of the substrate 306 with deep reactive in etching all the way through to the etch stop layer 304 to form the diaphragm 318. The seventh step is particular to one embodiment of the invention (shown in FIGS. 3*d* and 3*e*). In this one embodiment the seventh step is to remove the etch stop layer 304 in order to free the diaphragm membrane 302 via reactive ion etching 316 and later 318. Finally, the last step of the method is to release the coupling beam 310 by removing the sacrificial layer 312. The sacrificial layer 312 is removed in a dry etch process to avoid restriction between the beam 310 and the substrate 306. It is important to note that with a photo-resist sacrificial layer 312 oxygen plasma is used to remove the material 312 effectively and efficiently.

Referring back now to FIGS. 1*a* and 1*b* for clarity. During operation the invention functions as follows, an incident sound wave excites the diaphragm 106 closest to it causing a deflection. The diaphragm 106 spacing is minute relative to the speed of sound, so the response of neighboring diaphragms to the sound would be similar if the coupling beam 108 were not present. Through the stiff beam 108, the motion of one membrane 106 exerts an additional force on the other diaphragm 106. In some frequency bands and at low incident angles, the diaphragms 106 typically react with an almost identical response, causing an asymmetric motion about the pivot, or bending mode. There are at least several bending mode resonances at various different frequencies.

In certain other frequency bands, an out of phase, asymmetric response about the pivot point or central anchor 110 of the coupling beam 108 occurs. At the peak resonant frequency in this band, the pure rocking mode of the stiff beam 108 is observed. This frequency is dependent on the stiffness ratio between the beam 108 and the diaphragms 110. Ideally the diaphragms are 180° out of phase at this frequency.

The response of each diaphragm 106 can be measured and compared. Measurements can be performed by laser Doppler vibometry, fiber-optic interferometry, piezoresistive or piezoelectric elements built into or on top of the membranes 106 or any other method of optical or noncontract mechanical displacement detection. By comparing phase difference between the diaphragms 106, the apparent time of arrival delay or mechanical interaural time difference ITD, can be determined. Sound localization is best achieved in between bending mode and rocking mode resonant frequencies. The ITD is greatest at 90° incident angle and as the sound source approaches the zenith incident angle, the ITD becomes minimal, as both membranes 106 react equally.

At higher frequencies, uncharacteristic higher order modes, such as combinational and twisting modes occur. The measured phase difference response at various incident angle degrees showing the device directional sensitivity can also be noted.

Sound localization is normally achieved with an array of two or more microphones using directional cues. An incident sound will arrive at first to the closest microphone with a higher intensity. Then due to the propagation of sound at a fixed speed through air, there is a delay in the time of arrival to the microphone or microphones that are further away. This is commonly referred to as the inter-aural time difference. Between the closest microphone and the other microphones in the array the inter-aural time difference appears. Also due to attenuation in propagating medium the sound intensity will also decrease creating an inter-aural intensity difference. By comparing the inter-aural time difference (ITD) or the inter-aural intensity difference (IID) or both, sound localization can be achieved. However there is a limitation to these conventional microphone arrays: as the distance between the microphones is reduced the inter-aural time difference (ITD) and the inter-aural intensity difference (IID) both approach zero thereby limiting directional sensitivity.

This invention improves upon the limitations of conventional directional microphones by amplifying the apparent mechanical ITD at the rocking mode frequency. The invention has demonstrated an 11× amplification in the ITD between two diaphragms 106 at a 90° incident angle. The two diaphragms in this MEMS device are spaced 1.25 mm apart. With the amplification achieved by coupling the two membranes together, equivalent sound localization performance to an uncoupled microphone pair separated by distance of 13.75 mm can be achieved. The inventors have not seen any publications by any other group which discusses significant time difference application with MEMS differential microphones.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the subject matter described herein. Therefore, it is manifestly intended that this invention be limited only by the claims and equivalents thereof.

What is claimed is:

1. A micro scale implementation of a bio-inspired acoustic localization device comprising:

a substrate composite having a top side and a bottom side and a thickness;

at least two recesses formed on the bottom side of the substrate through more than half of the thickness of the substrate;

at least two continuous membranes composed of Polysilicon and formed over the recesses;

a rigid connection between the membrane perimeter and the substrate;

a mechanical coupling stiff beam is connected on the top of the substrate to areas over the recesses formed in said bottoms of said substrate;

a plurality of anchors that suspend and affix said mechanical beam to said areas of said substrate such that the mechanical beam does not touch the top of said substrate;

at least two anchor points having a thickness formed on said top of said substrate and located at the ends of said mechanical beam.

2. The micro scale implementation of a bio-inspired acoustic localization device of claim 1, wherein said anchors are rigidly connected to the membranes.

3. The micro scale implementation of a bio-inspired acoustic localization device of claim 1, wherein three membranes are located over 3 diaphragms and said mechanical coupling beam is of a substantially triangular shape.

4. The micro scale implementation of a bio-inspired acoustic localization device of claim 1, wherein 3 membranes are provided and said mechanical coupling beam is of a substantially "Y" shape.

5. The micro scale implementation of a bio-inspired acoustic localization device of claim 1, wherein said mechanical coupling beam is of a substantially "L" shape.

* * * * *